United States Patent [19]

Simms

[11] 3,932,964

[45] Jan. 20, 1976

[54] MULTI-ANGLE GRINDING FIXTURE

[75] Inventor: James B. Simms, Taylor, Mich.

[73] Assignee: James B. Simms, Taylor, Mich.

[22] Filed: Dec. 13, 1971

[21] Appl. No.: 207,361

[52] U.S. Cl. ..... 51/220; 51/221 BS

[51] Int. Cl.[2] ..... B24B 3/24

[58] Field of Search..... 51/220, 221, 218 R, 218 A, 51/219 R, 225

[56] References Cited

UNITED STATES PATENTS

| | | | |
|---|---|---|---|
| 1,426,965 | 8/1922 | Crowther | 51/221 R |
| 2,375,358 | 5/1945 | Hart | 51/220 |
| 2,409,936 | 10/1946 | Hunt | 51/220 |
| 2,470,530 | 5/1949 | Stryhal | 51/220 |
| 3,065,580 | 11/1962 | Benjamin et al. | 51/220 |
| 3,395,496 | 8/1968 | Sweeny | 51/220 |

*Primary Examiner*—Al Lawrence Smith
*Assistant Examiner*—Nicholas P. Godici
*Attorney, Agent, or Firm*—Robert G. Mentag

[57] ABSTRACT

A multi-angle grinding fixture comprising a block formed from suitable steel which has slots for holding a spade drill blade in predetermined positions. The blade is held in a first slot for grinding the primary side clearance on each side of the blade. The blade is held in a second slot for grinding a secondary side clearance on each side of the blade. The blade is held in a third slot for cutting the cutting lip angle or for grinding the cutting lip angle on each side of the blade. The blade is held in a fourth slot for cutting or grinding the radius of the cutting edge lip on each side of the blade. The fixture block may be used for either new construction work on a blade or for regrinding a blade.

1 Claim, 9 Drawing Figures

INVENTOR.
James B. Simms
BY
Robert D. Ingentag
ATTORNEY

INVENTOR.
James B. Simms
BY
Robert D. Inventag
ATTORNEY

INVENTOR.
James B. Simms
BY
Robert D. Ingentag
ATTORNEY

INVENTOR.
James B. Simms
BY
Robert D. Ingentag
ATTORNEY

MULTI-ANGLE GRINDING FIXTURE

SUMMARY OF THE INVENTION

This invention relates generally to improvements in the cutting tool art, and more particularly to a novel and improved multiple angle grinding fixture block for holding a spade drill blade in a number of positions for grinding operations thereon. Heretofore, when regrinding the cutting edges and surfaces of a spade drill blade, it has been necessary to employ much set-up time for positioning the blade relative to a grinding wheel to properly grind all of the desired cutting edge surfaces. The prior art procedure is time consuming and costly. Accordingly, it is an important object of the present invention to provide a novel and improved multi-angle grinding fixture block which overcomes the disadvantages of the prior art methods for grinding a spade drill blade. It is another object of the present invention to provide a grinding fixture which may be used for regrinding an entire series of spade drill blades. No special grinder or cylindrical grinding fixtures are needed when using the grinding fixture of the present invention. Only a surface grinder and the multi-angle grinding fixture is needed to precision regrind all of the cutting surfaces of the spade drill blade.

It is another object of the present invention to provide a novel and improved multi-angle grinding fixture block which is simple and compact in construction, economical to manufacture and efficient in use.

It is another object of the present invention to provide a novel and improved multi-angle grinding fixture which is adapted to hold the spade drill blade having an axial rib along the sides thereof, but which fixture may also be used for other spade drill blades having different cross section configurations.

Other objects, features and advantages of this invention will be apparent from the following detailed description, appended claims, and the accompanying drawings.

DESCRIPTION OF THE PREFERRED EMBODIMENT

Figure 1:
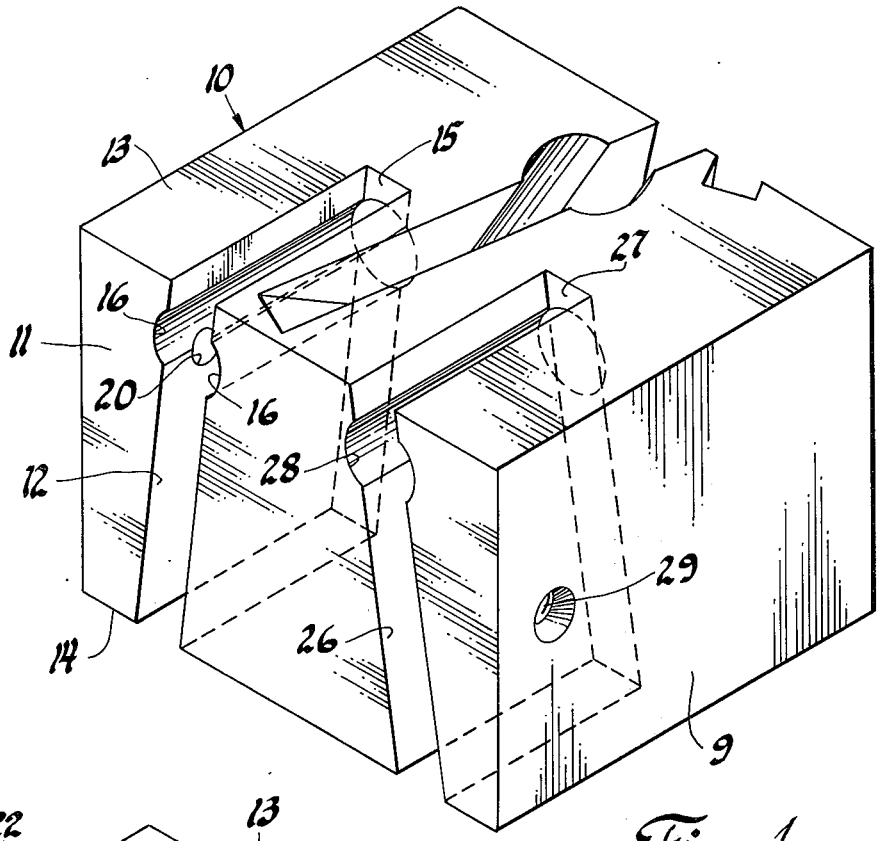
FIG. 1 is a perspective view of a multiple angle grinding fixture made in accordance with the principles of the present invention.
Figure 2:
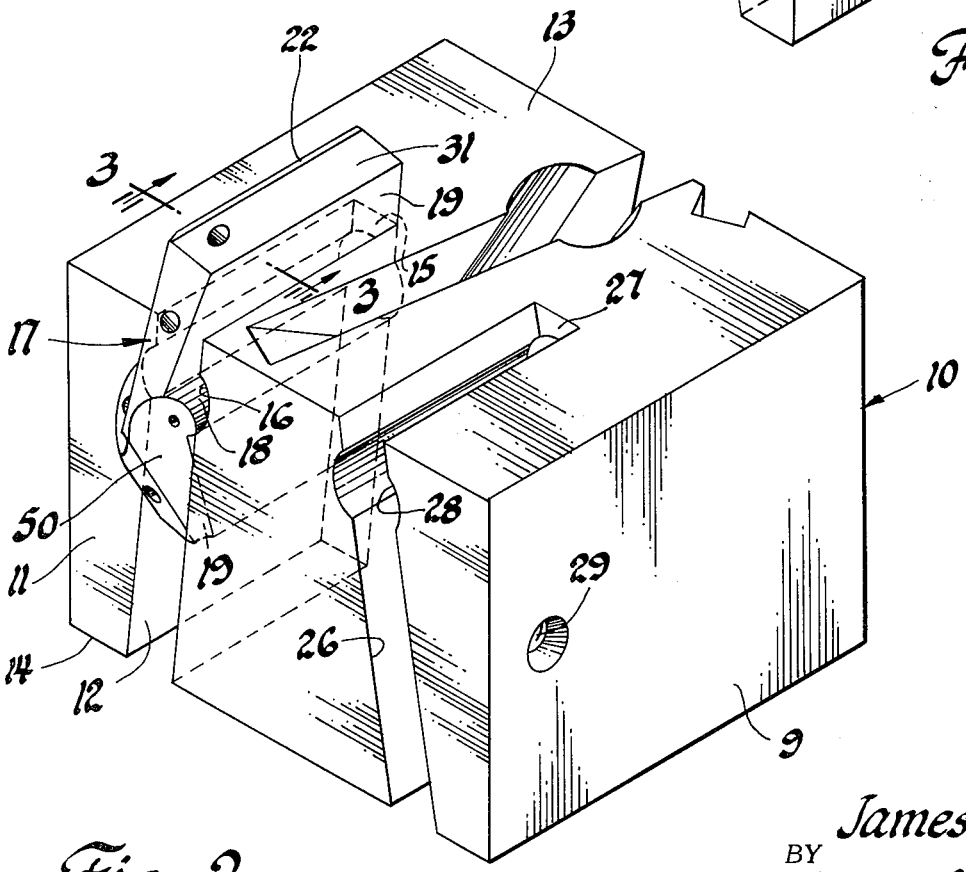
FIG. 2 is a view similar to FIG. 1 and showing a spade drill blade mounted in the grinding fixture and disposed in the block in a position for grinding the primary back-off or side clearance.
Figure 3:
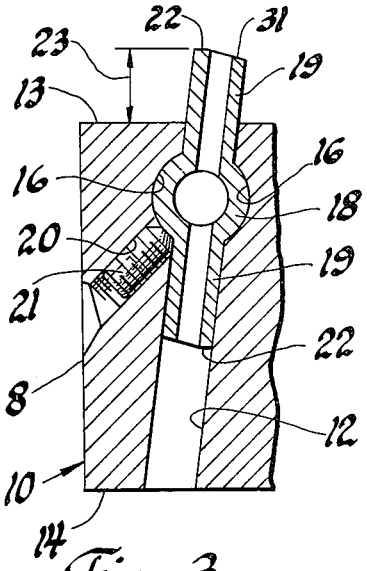
FIG. 3 is a fragmentary, elevational, section view of the structure illustrated in FIG. 2, taken along the line 3—3 thereof and looking in the direction of the arrows.

Referring now to the drawings, the numeral 10 in FIG. 1 generally designates a multiple angle grinding fixture made in accordance with the principles of the present invention. As best seen in FIGS. 1, 2 and 3, the grinding fixture 10 is shaped as a block and it is made from a suitable material as, for example, cold rolled steel. The sides of the block are all ground square, and the corners are all broken. One embodiment was made in the form of a block having the dimensions of 4 and ½ inches in one direction, 6 inches in another direction and 5 inches in the other direction.

Figure 4:
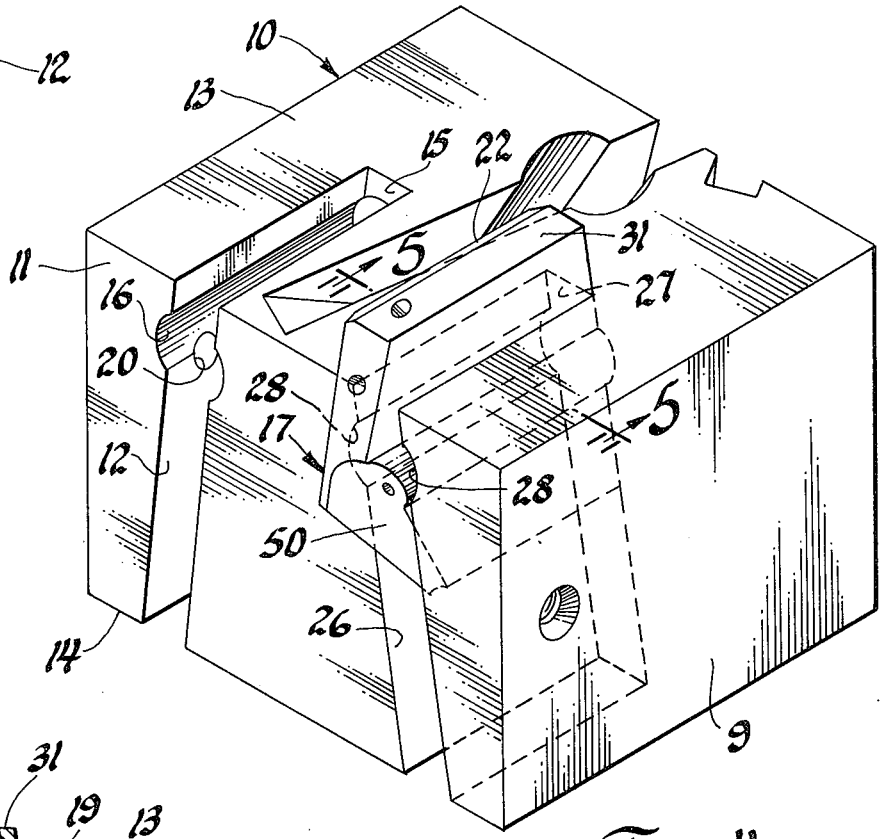
FIG. 4 is a view similar to FIG. 1 and showing the spade drill blade mounted in a second slot in the grinding fixture block for grinding the secondary back-off or side clearance.
Figure 8:
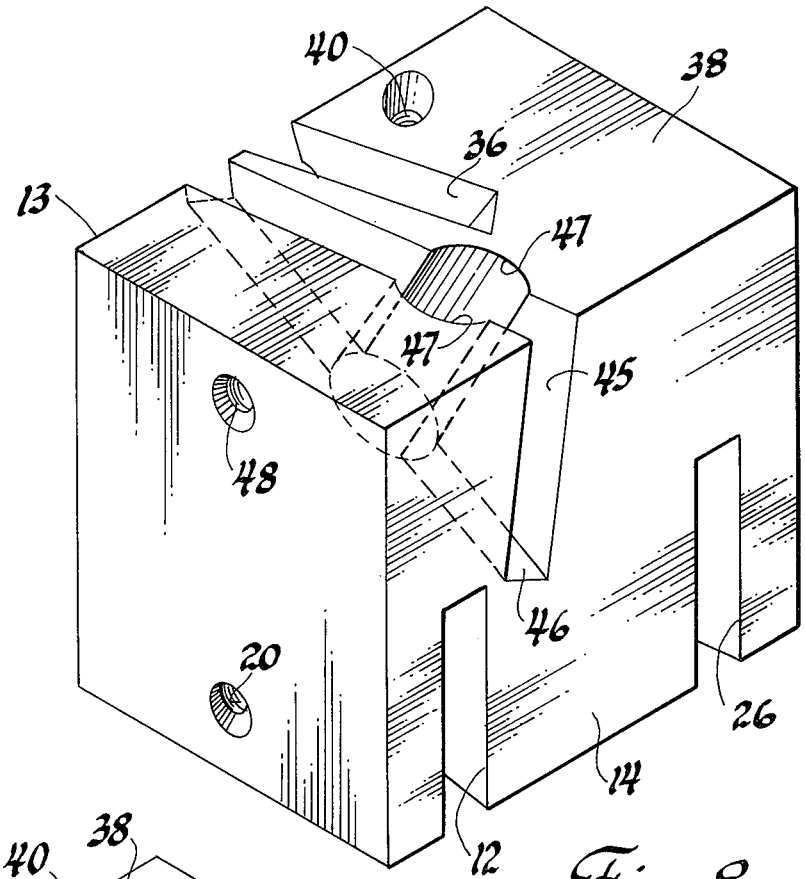
FIG. 8 is a perspective view of the grinding fixture block illustrated in FIG. 1, and with the block being disposed on still another side to present a fourth slot for holding a spade drill blade in still another position.

As shown in FIGS. 3 and 4, the block has the two side parallel surfaces 8 and 9, and a top surface 13 which is perpendicular to the two side surfaces 8 and 9. The numeral 14 in FIG. 3 indicates the bottom surface which is parallel to the top surface 13 and perpendicular to the side surfaces 8 and 9. As shown in FIGS. 1, 2 and 3, the front surface 11 of the block is perpendicular to the side surfaces and the top surface and it is parallel to the rear surface which is indicated in FIG. 8 by the numeral 38.

As best seen in FIGS. 1, 2 and 3, the grinding fixture block 10 is provided with a first slot 12 which is extended inwardly from a side 11 when the block is disposed on the bottom surface 14, as shown in FIGS. 1 and 2. As shown in FIGS. 1 and 3, the slot 12 is disposed at an angle from the vertical axis as viewed in these figures as, for example, at an angle of 7°, so as to permit the insertion into the slot 12 of a spade drill blade, generally indicated by the numeral 17 in FIG. 2, for grinding the primary back-off or side clearance on each side of the drill blade. The slot 12 extends completely through the block from the top surface 13 to the bottom surface 14 and inwardly to the point designated by the numeral 15. Adjacent the upper end of the slot 12, a bore 16 is formed into the slot 12 to provide a circular seat for the enlarged axial rounded rib 18 of the blade 17, as shown in FIG. 3. As best seen in FIG. 3, the spade drill blade 17 includes the two blade portions 19 on each side of the center rib 18, and the width of the slot 12 is made so as to slidably receive the blade portions 19 in a free sliding but closely held position. As best seen in FIG. 3, an upwardly disposed threaded hole 20 is provided adjacent the slot 12, and it is extended inwardly from the left side surface 8. A set screw 21 as, for example, an allen screw, is threadably mounted in the hole 20 and its inner end is adapted to engage the rib 18 and lock the blade 17 in place, during a grinding operation on the back-off edge 22. It will be seen that when the block 10 is disposed on the table of a suitable grinding machine in the position shown in FIGS. 2 and 3, that the back-off or side clearance 22 can be quickly and efficiently ground along one side of the blade 17, and that the other side of the blade can also be ground along the opposite back-off edge 22 by merely removing the blade from the slot 12 and turning it 180°, in a minimum of time.

The spade drill blade of the type illustrated in FIGS. 1 and 2 which can be quickly and easily ground in an efficient manner by the use of the grinding fixture of the present invention is shown in detail in my U.S. Pat. No. 3,293,727, which issued on Dec. 27, 1966 and is entitled CUTTING TOOL.

The numeral 23 in FIG. 3 designates the height above the upper surface 13 of a block that the final back-off or side clearance surface is disposed at after a grinding operation has been completed. It is thus seen that by forming the slot 12 with its circular seat 16 at the proper position in the block, that the back-off edge 22 can be precisely ground in a quick and efficient manner.

Figure 5:
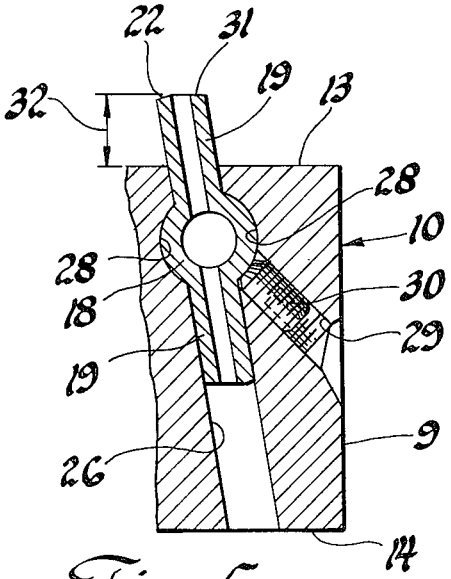
FIG. 5 is a fragmentary, elevational, section view of the structure illustrated in FIG. 4, taken along the line 5—5 thereof and looking in the direction of the arrows.

FIGS. 4 and 5 show the spade drill blade 17 disposed in a second slot 26 which is formed in the block 10 in a position adjacent the first block 12. The slot 26 extends inwardly from the front face 11 to a point indicated by the numeral 27. The slot 26 is also provided with a circular seat formed by a bore 28 for receiving the rib 18 of the blade 17. The bore 28 is disposed so as to maintain the secondary side or back-off clearance 31 at a predetermined position above the top surface 13 after a grinding operation has been performed on a secondary side surface 31. As shown in FIG. 5, a threaded bore 29 is formed in the block and extends inwardly from the right side surface 9, as viewed in FIGS. 4 and 5, and a threaded allen set screw 30 is mounted in the threaded bore 29 and it is adapted to hold the blade 17 in position in the slot 26 during a grinding operation.

The slot 26 would be disposed at an angle from the vertical axis, as viewed in FIG. 5, in accordance with the angle of the secondary side surface 31. For example, in one embodiment the slot 26 was disposed at an angle of 15° from the vertical axis. It will be understood of course that the angle of the slot would be formed in accordance with the final desired edge 31. It will be understood that the secondary back-off angle on the opposite side of the blade may be quickly and easily ground by merely reversing the blade in the slot 26.

Figure 6:
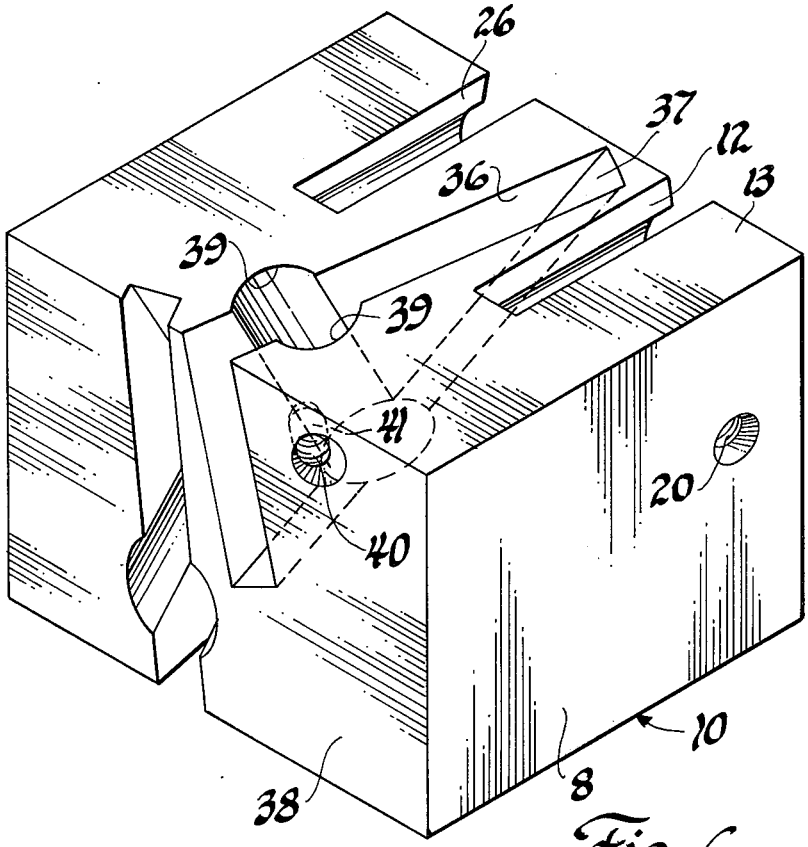
FIG. 6 is a view of the grinding fixture of the present invention, and it is similar to FIG. 1 but with the block turned 180°.
Figure 7:
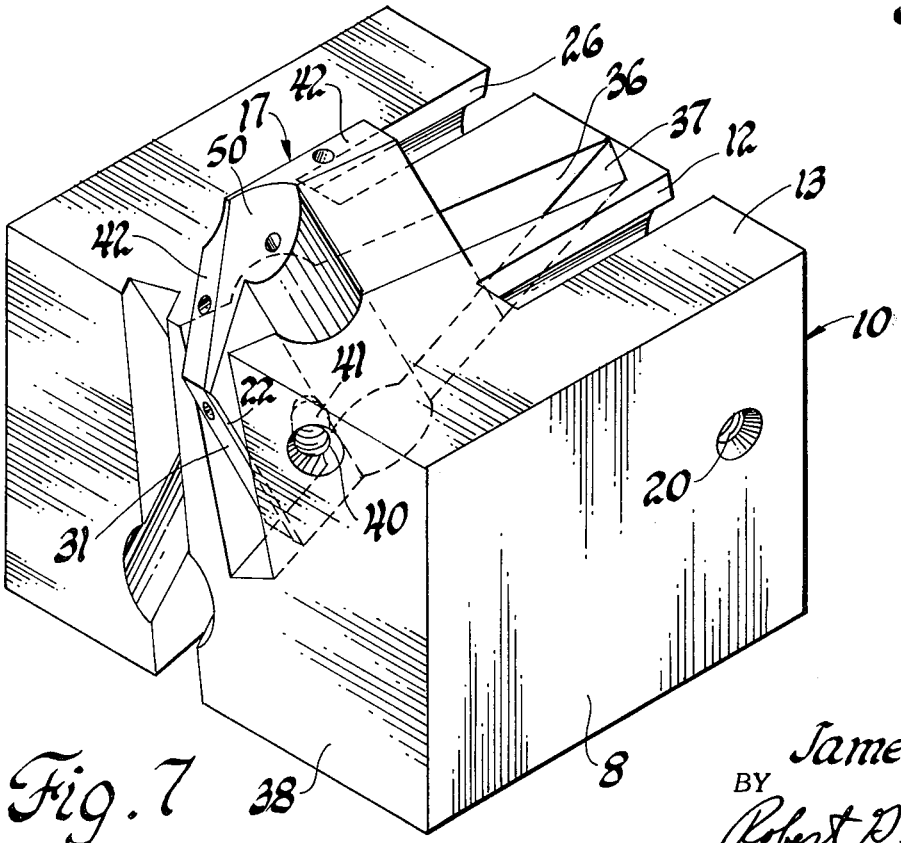
FIG. 7 is a view of the grinding fixture which is the same as FIG. 6, but with the spade drill blade mounted in a third slot in the block to permit the cutting of the lip angle of the spade drill blade.

FIGS. 6 and 7 illustrate the function of a third slot in the block which is designated by the numeral 36, and which extends inwardly from the top surface 13 of the block to a point designated by the numeral 37. The slot 36 is also provided with a circular bore 39 for receiving the rib 18 of the spade drill blade 17. The circular seat 39 is formed in relation to the rear surface 37 of the slot 36 so as to position the cutting lip 42 of the blade 17 at a final level above the surface 13 after the surface 42 has been ground.

FIG. 7 shows the blade 17 in an operative position with one cutting lip 42 being disposed in a position to hold the lip 42 parallel to the surface of a grinding table. Accordingly, the slot 36 is tipped at an angle relative to the vertical surface of about 15°. That is, relative to a perpendicular plane passing through the block from the surface 38, as viewed in FIG. 6, a slot 36 would be tipped 15° from said vertical plane. Also, as viewed in FIGS. 6 and 7, if a plane were passed from the surface 8 and to the left as viewed therein through the centerline thereof, then the axis of the seat 39 would be tipped from that plane towards the front of the block, as viewed in FIGS. 6 and 7, at a desired angle of about 28° for the illustrated blade. It will be understood that the last mentioned angles would be varied in accordance with the desired angle to be placed on the cutting tool for the cutting lip angle. It will also be understood that the cutting lip angle 42 on each side of the blade 17 may be quickly and easily ground by merely reversing the blade in the slot 36. Each of the cutting lip angles 42 is parallel to the surface of the grinding table during a grinding operation when held in the slot 36. As shown in FIGS. 6 and 7, a set screw 41 is mounted in a threaded hole 40 to retain the blade 17 in place during a grinding operation.

Figure 9:
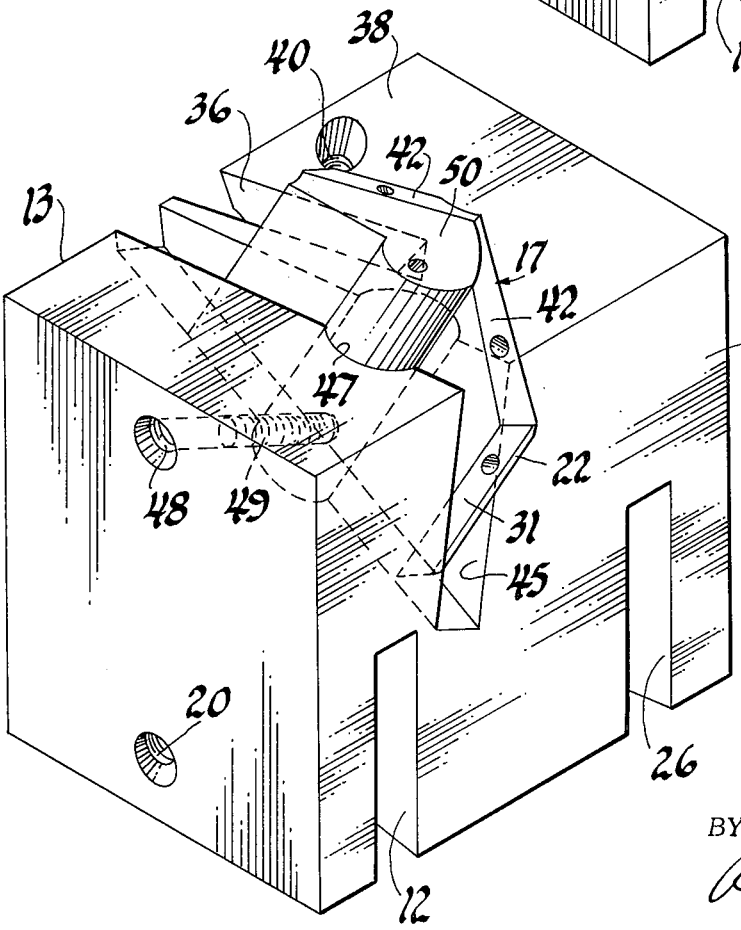
FIG. 9 is the same view as FIG. 8 of the grinding fixture block of the present invention, and showing a spade drill blade mounted in said fourth slot to permit the radius of the cutting edge lip to be ground.

As shown in FIGS. 8 and 9, the block 10 is provided with a fourth slot which is cut inwardly from the surface 38, and this fourth slot is indicated by the numeral 45. It extends inwardly to the surface marked by the numeral 46, and it is also provided with the circular seat 47. A set screw 49 is threadably mounted in the bore 48 and is adapted to retain the blade 17 in the slot 46 during a grinding operation. Assuming that when the block is disposed in the positions of FIGS. 8 and 9 and that it is resting on what was the front surface 11 in FIGS. 1 and 2, it holds the blade 17 in a position whereby the radius 50 of the cutting edge lip may be quickly and efficiently ground by passing a grinding wheel with a proper radius along the edge 50. The slot 45 is again disposed at the necessary angle in accordance with the angle of the cutting edge lip. It is seen that the axis of the circular seat 47 that holds the rib of the blade is tilted in three directions. For example, the bore 47 would be tilted forwardly towards the surface 14 from the surface 13 at an angle of approximately 28° for one type of blade. It would also be tilted from the vertical axis and towards the right as viewed in FIGS. 8 and 9, at an angle of about 15°. It would then also be turned counter-clockwise from a plane extending perpendicular between the surfaces 13 and 18 at an angle of 4°. It is thus seen that the axis of the circular seat 47 for the slot 45 is tilted in three directions or in three axes.

In use, the block is disposed on a proper surface for putting into operation the desired slot and the desired grinding operation, and can then be quickly and easily carried out by passing a grinding wheel over the blade at a position to automatically provide the desired grinding operation on the blade. It will be understood that the grinding fixture of the present invention can be used for regrinding used tools or it can be used in new construction for milling and grinding work to provide the proper angles on a blade.

While it will be apparent that the preferred embodiment of the invention herein disclosed is well calculated to fulfill the objects above stated, it will be appreciated that the invention is susceptible to modification, variation and change.

What I claim is:

1. A multi-angle grinding fixture for holding a spade drill blade in a number of positions for grinding operations thereon, comprising:

a. a body member shaped as a block and having parallel side faces, parallel top and bottom faces, and parallel front and rear faces;

b. said body member being provided with at least four inwardly extended slots for holding a spade drill blade in four different positions for grinding the primary side clearance surfaces, the secondary side clearance surfaces, the cutting lip angles, and the radii of the cutting edge lips of the blade;

c. each of said slots being angularly disposed relative to a particular block face to hold a spade drill blade at a predetermined angle when the block is seated on said particular block face to allow a particular cutting surface on the blade to be ground by a surface grinder;

d. each of said slots being provided with a rectangular cross-sectional configuration with a pair of laterally spaced apart parallel side walls and a circular seat formed centrally in each side wall and extended longitudinally of said slot, whereby each slot mates with and receives a spade drill blade to be held therein for a grinding operation on the blade; and, e. means adjacent each of said slots for releasably locking a spade drill blade in each slot to hold the blade in a predetermined position for the grinding of a particular cutting surface when the body member is disposed with a particular one of said block faces downwardly.

* * * * *